US006632780B2

(12) United States Patent
Uematsu et al.

(10) Patent No.: US 6,632,780 B2
(45) Date of Patent: Oct. 14, 2003

(54) HIGHLY THERMAL CONDUCTIVE GREASE COMPOSITION AND COOLING DEVICE USING THE SAME

(75) Inventors: Takao Uematsu, Hitachi (JP); Yutaka Ito, Takahagi (JP); Takahiro Daikoku, Ushiku (JP); Akio Idei, Hadano (JP); Akihiro Yasuda, Hadano (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/798,051

(22) Filed: Mar. 5, 2001

(65) Prior Publication Data

US 2003/0008961 A1 Jan. 9, 2003

(51) Int. Cl.[7] ..... C10M 113/08; C10M 169/00

(52) U.S. Cl. ..... 508/155; 508/165; 508/172; 508/465; 508/481; 508/485; 508/580; 508/581

(58) Field of Search ..... 508/172, 165, 508/155, 160

(56) References Cited

U.S. PATENT DOCUMENTS

| | | | | | |
|---|---|---|---|---|---|
| 3,935,114 | A | * | 1/1976 | Donaho, Jr. | 508/165 |
| 4,128,486 | A | * | 12/1978 | Palmer et al. | 508/155 |
| 4,715,972 | A | * | 12/1987 | Pacholke | 508/165 |
| 5,981,641 | A | * | 11/1999 | Takahashi et al. | 508/172 |
| 6,040,277 | A | | 3/2000 | Caporiccio | |
| 6,174,841 | B1 | * | 1/2001 | Yamada et al. | 508/172 |
| 6,255,257 | B1 | * | 7/2001 | Yamada et al. | 508/172 |
| 6,372,337 | B2 | * | 4/2002 | Takahashi et al. | 508/172 |

FOREIGN PATENT DOCUMENTS

| | | |
|---|---|---|
| JP | A-51-55870 | 5/1976 |
| JP | B-52-33272 | 8/1977 |
| JP | A-54-116055 | 9/1979 |
| JP | A-55-45770 | 3/1980 |
| JP | B-57-36302 | 8/1982 |
| JP | A-61-157587 | 7/1986 |
| JP | A-63-57693 | 3/1988 |
| JP | A-63-251455 | 10/1988 |
| JP | A-2-153995 | 6/1990 |
| JP | A-2-212556 | 8/1990 |
| JP | A-2-14873 | 1/1991 |
| JP | A-3-106996 | 5/1991 |
| JP | A-3-162493 | 7/1991 |
| JP | A-4-63895 | 2/1992 |
| JP | A-4-117482 | 4/1992 |
| JP | A-4-239597 | 8/1992 |
| JP | A-10-140173 | 5/1998 |
| JP | 2925721 | 5/1999 |
| JP | 2930298 | 5/1999 |
| JP | 2938428 | 6/1999 |
| JP | 2938429 | 6/1999 |
| JP | A-2000-109373 | 4/2000 |
| JP | A-2000-169873 | 6/2000 |

* cited by examiner

*Primary Examiner*—Ellen M. McAvoy
(74) *Attorney, Agent, or Firm*—Antonelli, Terry, Stout & Kraus, LLP

(57) ABSTRACT

There are provided a highly thermal conductive grease composition having both a thermal conductivity and a satisfactory dispense property, and a cooling device applied with same. The grease composition comprises from 70 to 90% by volume of an inorganic powder which is a mixture containing at least two kinds of inorganic powders different from each other in each average particle size, and from 10 to 30% by volume of a base oil containing a mineral oil or a synthetic oil, the base oil further containing a surfactant in an amount of from 0.2 to 2.0% by weight based on the weight of the inorganic powder.

7 Claims, 4 Drawing Sheets

HIGHLY THERMAL CONDUCTIVE GREASE COMPOSITION AND COOLING DEVICE USING THE SAME

FIELD OF THE INVENTION

The present invention relates to a thermal conductive material applied between an exothermic portion and a cooling portion in electric and electronic apparatus etc. More specifically, the present invention relates to a highly thermal conductive grease composition comprising an inorganic powder and a cooling device applied with same.

BACKGROUND OF THE INVENTION

Efficiency of a cooling device used for removing heat generated by an integrated circuit element greatly depends upon a thermal conductivity, i.e. a thermal resistance, of a thermal conductive grease which is called also a thermal conductive compound and which is filled in a contact surface between an exothermic surface and a radiating portion in the integrated circuit element. As a material used for the thermal conductive grease composition for the integrated circuit element, there is used a material that is possessed of an electrical insulation and that is capable of quickly removing the generated heat through a radiating portion, because the grease composition is brought into indirect or direct contact with both the integrated circuit element and the radiating surface.

As the thermal conductive grease, there are so far known those comprising a base oil including a silicone oil such as polydimethylsiloxane and polymethylphenysiloxane and a heat transfer substance including a powder such as aluminum nitride, silica, alumina, metal silicon, boron nitride and zinc oxide (cf. JP-A 51-55870, JP-B 52-33272, JP-A 54-116055, JP-A 55-45770, JP-A 61-157587, JP-A 2-153995, JP-A 2-212556, JP-A 3-14873, JP-A 3-162493, Japanese Patent No. 2925721, Japanese Patent No. 2938429, and JP-A 2000-109373).

Japanese Patent No. 2930298 discloses a thermal conductive grease composition comprising an aluminum nitride powder which is surface-treated with an organosilane and/or a partially hydrolyzed condensate thereof and a base oil of a liquid hydrocarbon oil or a fluorohydrocarbon oil. However, the thermal conductivity thereof is about 2.3 W/m·K, which is not satisfactory.

Japanese Patent No. 2938429 discloses a thermal conductive silicone composition comprising a silicone oil and thermal conductive inorganic fillers different from each other in each Moh's hardness. However, the thermal conductivity thereof is also from 2.72 to 3.97 W/m·K, which is not sufficiently satisfactory.

For the purpose of preventing isolation and bleeding of the silicon oil, JP-B 57-36302 discloses a thixotropic thermal conductive material prepared using a silica fiber, a dendrite like zinc oxide, a laminal aluminum nitride and a laminal boron nitride.

Further, there are disclosed a thermal conductive grease comprising perfluoro polyether as the base oil in JP-A 63-251455 and JP-A 3-106996, which is proposed mainly to improve a contact default, some grease blended with a urea compound in JP-A 4-117482, some grease added with a fluoro-surfactant in JP-A 63-57693 and JP-A 4-239597, which are proposed to prevent isolation and bleeding of the oil, and some grease prepared using a fluorine compound having a polyfluoroalkyl group and at least one oxyalkylene group in JP-A 10-140173. However, the thermal conductivity thereof is about 2.3 W/m·K, which is not satisfactory from a viewpoint of heat removal.

Japanese Patent No. 2938428 discloses some grease comprising a liquid hydrocarbon oil and/or a fluorohydrocarbon oil as the base oil and a combination of a specific thermal conductive inorganic filler having a thermal conductivity of not less than 100 W/m·K and another specific thermal conductive inorganic filler having a thermal conductivity of not less than 20 W/m·K, which are proposed to further improve a dispense property and a high thermal conductivity. The thermal conductivity of the grease disclosed is as remarkably good as from 2.59 to 4.02 W/m·K, and its dispense property is also good. A content of the base oil which is a liquid hydrocarbon oil and/or a fluorohydrocarbon oil used in these grease is found to be 10% by weight, which is calculated on the basis of the disclosure of Example. An oil-isolation degree measured at 150° C. for 24 hours according to JIS-K-2220 is found to be 0% by weight in every cases. Notwithstanding, a diffusion due to bleeding of the oil is caused when the grease is subjected to a heating test of 150° C./20 hours, in which the grease is coated on an aluminum nitride plate in a circular and gable roof form.

BRIEF SUMMARY OF THE INVENTION

It is an object of the present invention to provide a highly thermal conductive grease composition having both a high thermal conductivity and a satisfactory dispense property. It is another object of the present invention to provide a cooling device applied with same.

The present invention provides a highly thermal conductive grease composition which comprises an inorganic powder and a base oil containing a mineral oil or a synthetic oil, wherein the inorganic powder is a mixture of at least two kinds of inorganic powders different from each other in each average particle size, the base oil further contains a surfactant in an amount of from 0.2 to 2.0% by weight based on the weight of the inorganic powder, and a content of the base oil is from 10 to 30% by volume, and a content of the inorganic powder is from 70 to 90% by volume.

The present invention further provides a cooling device provided with an electric or electronic component assembled into an apparatus and a cooling body put on a surface of said component, in which the highly thermal conductive grease composition as above intervenes between said cooling body and a surface of an exothermic body in said component.

Figure 1:
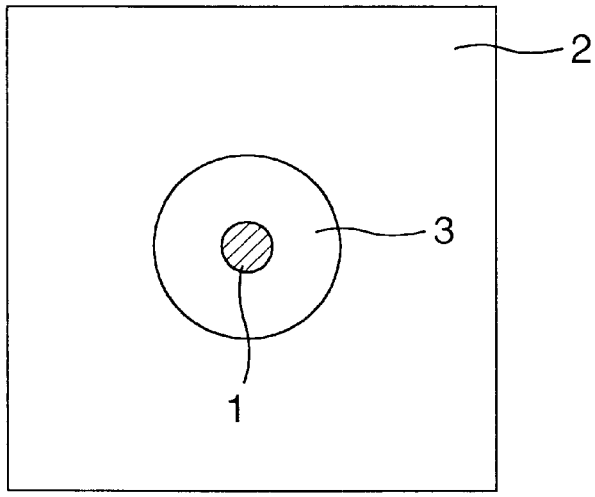
FIG. 1 is a drawing to illustrate a method for testing diffusion of the base oil.

Numerical marks are explained as follows;

1: grease, 2: aluminum nitride plate, 3: portion of the base oil diffusion, 4: radiating body, 5: radiating plate, 6: exothermic body, 7: thermal conductive grease, 8: coarse particles and 9: fine particles.

DETAILED DESCRIPTION OF THE INVENTION

In the study of the prior arts, the thermal conductivity can be increased with an increase in a filler content of a thermal conductive inorganic filler, while the grease becomes hard (low consistency) to deteriorate its dispense property. In order to improve the dispense property, it is forced to lower a content of the thermal conductive powder, and as a result, a sufficient thermal conductivity cannot be obtained.

The dispense property is intended to mean a degree of workability on coating of grease such as, for example, spread on a surface to be coated, flow properties and adherability, and is related to hardness of the grease. In the case where the dispense property is insufficient, it may be made difficult to extrude the grease or coat the grease thinly using a filling machine provided with a syringe or a cylinder like coating means.

For that reason, the thermal conductive grease is required to attain a good dispense property and a high thermal conductivity at the same time. It is necessary therefor to study a filler content, shape and average particle size of the thermal conductive powder, a viscosity of the base oil, and a surfactant causing no decrease of the electrical resistance. Particularly, in order to realize miniaturization of a cooling structure and in order to apply to a cooling device used for electronic components which are high in an integration density and great in a calorific value, it is necessary to attain a high thermal conductivity and further improve bleeding and diffusion properties of the base oil.

With respect to a thermal conductive grease comprising a silicone oil as the base oil, the silicone oil is very low in its surface tension and its interfacial tension, and therefore there is a tendency such that an isolation of the base oil occurs to cause a decrease in thickness and volume of the grease, and as a result, shrinkage and cracking of the grease are produced. Therefore, it may happen that a void is formed between an exothermic surface and a radiating surface, so that a temperature of the exothermic portion rises.

Further, there is a possibility such that the base oil isolated from the grease or the silicone oil bled therefrom easily diffuse to stain the periphery or causes a formation of an insulating material such as silicon dioxide ($SiO_2$) and silicon carbide (SiC), and at last electric and electronic apparatus are put out of order, which insulating material can be produced from a low molecular weight siloxane which is contained in the silicone oil or which is produced by degradation of the silicone oil with the aid of spark heat at an electrical contact point.

For enabling electric and electronic components to suitably function, which components are assembled into electric and electronic apparatus, respectively, it is necessary that a thermal conductive grease to be filled in or coated to a contact surface between an exothermic portion and cooling portion of the components is high in its thermal conductivity and its electrical insulation, satisfactory in its dispense property and moreover free from an isolation and a diffusion of the base oil. For the purpose of obtaining such a high performance thermal conductive grease, the present inventors have undertaken extensive studies about a base oil which is a constituting material of the grease and its viscosity, a particle size of a thermal conductive inorganic powder, a blending proportion of coarse particles and fine particles present in the powder, a filler content thereof, and a surfactant exhibiting a satisfactory addition effect without great detriment to decrease in electrical resistance. As a result, the present inventors have found the facts that;

(1) with respect to the thermal conductive inorganic powder, the filler content thereof can be increased with decrease in the viscosity of the base oil, (2) the thermal conductivity varies depending upon the particle size of a crystalline thermal conductive material rather than the kind and powder form thereof, and the larger the particle size, the higher the thermal conductivity, and (3) a specific nonionic surfactant is added to the base oil effectively to increase the filler content of the thermal conductive inorganic powder, to increase a consistency and moreover to control and prevent isolation and diffusion of the base oil, and thereby the present invention was accomplished.

In accomplishing the foregoing objects, there is provided according to the present invention a highly thermal conductive grease composition, which comprises from 70 to 90% by volume of an inorganic powder containing a mixture of at least two kinds of inorganic powders different from each other in each average particle size, and from 10 to 30% by volume of a base oil containing a mineral oil or a synthetic oil, provided that the base oil further contains a surfactant in an amount of from 0.2 to 2.0% by weight based on the weight of the inorganic powder.

With respect to such a highly thermal conductive grease composition, a mutual contact area of the particles present in the grease is increased, so that the thermal conductivity is increased and at the same time the liquation consistency is improved to reach from 200 to 400, in other words, the grease composition becomes soft to be improved in its dispense property.

When such a highly thermal conductive grease composition is applied between the surface of an exothermic body and a cooling body of electric and electronic components, generated heat of the electric and electronic components can be effectively removed, and as a result, reliability of the components for electric and electronic apparatus can be improved and a cooling device can be made compact. In addition, since such a highly thermal conductive grease composition is free from an isolation and diffusion of the base oil and moreover possessed of an appropriate viscosity, it can be utilized as an adhesive agent when the electric and electronic components are assembled into electric and electronic apparatus, respectively, so that the production of electric and electronic apparatus can be facilitated.

Viscosity of the base oil used in the present invention is preferably from 15 to 450 $mm^2/s$ at 40° C. Examples of the base oil are α-olefin oligomers, diesters, polyol esters, trimellitic acid esters, polypheny ethers and alkyl phenyl ethers, which may be used singly or in combination of two or more.

The inorganic powder used in the present invention is preferably a combination of 40 to 90% by volume of coarse particles having an average particle size of from 5 to 17 μm, and 10 to 60% by volume of fine particles having an average particle size of from one third to one fortieth of that of the coarse particles. Examples of the inorganic powder are zinc oxide, magnesium oxide, titanium oxide, aluminum nitride, aluminum oxide and boron nitride, which may be used singly or in combination of two or more. Electrical characteristics of the inorganic powder can be selected depending on utilities of the highly thermal conductive grease composition, and the inorganic powder can be selected from conductors, semiconductors, insulators and dielectrics.

The surfactant used in the present invention is preferably a nonionic surfactant, particularly that having an HLB value of not more than 9.

PREFERRED EMBODIMENTS OF THE INVENTION

Kind of Base Oil

The base oil used in the present invention is a single or mixed oil, which is at least one member selected from mineral oils and synthetic oils. A particularly preferred synthetic oil is a hydrocarbon oil. Examples thereof to be used are α-olefin oligomers; diesters including dibasic acid esters obtained from alcohols and dibasic acids; polyol esters including polyol esters obtained from a polyhydroxyl alcohol having a carbon skeleton of neopentane and a fatty acid having 5 to 18 carbon atoms, or complex type polyol esters obtained from a mixed acid of aliphatic mono- and di-carboxylic acids having 4 to 10 carbon atoms and a polyhydroxyl alcohol of trimethylolpropane, pentaerythritol or dipentaerythritol; trimellitic acid esters, polyphenyl ethers; and alkyl phenyl ethers.

When it is not required to control and prevent an isolation and diffusion of the base oil, it is permitted to use a liquid silicone such as a methyl type silicone oil and a phenyl type silicone oil, and a fuluorohydrocarbon oil such as chlorofluorocarbon and perfluoro polyethers.

Viscosity of Base Oil

Viscosity of the base oil is preferably from 15 to 450 $mm^2$/sec. When the viscosity is less than 15 $mm^2$/sec, it may happen that an evaporation loss is increased, so that a grease layer coated becomes thin because of a decrease of an oil content due to an evaporation of the oil, thereby forming an air layer at a contact surface or causing a crack formation, and as a result, the thermal conductivity is decreased. Whereas, when the viscosity exceeds 450 $mm^2$/sec, it may happen that it is difficult to fill a large amount of the thermal conductive filler, so that a high conductivity cannot be obtained and at the same time a dispense property is deteriorated.

A content of the base oil is preferably from 10 to 30% by volume. The base oil content can be decreased with a decrease in the base oil viscosity, so that the inorganic powder content can be increased. However, when the base oil content is less than 10% by volume, it is apt to remarkably deteriorate the flow properties, adherability and dispense property, because the grease becomes hard. When the base oil content exceeds 30% by volume, the grease becomes remarkably soft to attain a satisfactory dispense property, but there is an unpreferable tendency such that a high thermal conductivity is hardly obtained and an isolation and diffusion of the base oil are caused.

Kind of Inorganic Powder

The inorganic powder includes those having a thermal conductivity to effectively transfer heat generated from the electric and electronic components. Examples thereof are metal oxides such as zinc oxide, magnesium oxide, titanium oxide and aluminum oxide; aluminum nitride; boron nitride; silicon carbide; silicon nitride; titanium nitride; metallic silicon and diamond, which may be used singly or in combination of two or more. The inorganic powder used is not limited thereto. The thermal conductivity of the grease greatly depends on the particle size of the thermal conductive inorganic powder rather than the thermal conductivity of the inorganic powder itself. Electrical characteristics of the inorganic powder may be selected depending on utilities of the grease. For example, when the grease is used for electronic components, an electrical insulating inorganic powder is usually used. When the electrical insulation is not required, it is permitted to use various kinds of metal powders.

Combination of Particle Size

With respect to the inorganic powder, coarse particles and fine particles different from each other in each average particle size and each particle distribution are combined in the optimum proportion, thereby to be able to form a close-packed structure. In the close-packed structure, voids among the coarse particles are closely buried with the fine particles and a mutual contact surface of the particles is large, and as a result, the thermal resistance among particles can be remarkably reduced to attain a high thermal conductivity of the grease.

It is preferable to use an inorganic powder which is a combination of coarse particles having an average particle size of from 5 to 17 μm and fine particles having an average particle size of from one third to one fortieth of that of the coarse particles. A preferred blending proportion of the coarse particles and the fine particles is within a range of from 90 to 40% by volume of the coarse particles: from 10 to 60% by volume of the fine particles. A more preferred proportion is from 80 to 60% by volume of the coarse particles: from 20 to 40% by volume of the fine particles. When the blending proportion of the coarse particles and the fine particles deviates from the range of from 90 to 40% by volume of the coarse particles: from 10 to 60% by volume of the fine particles, it is apt to fail to obtain a good close-packed structure, thereby decreasing the thermal conductivity.

In order to attain a high thermal conductivity, it is preferable to use a mixed powder in the blending proportion of from 90 to 40% by volume of the coarse particles from 10 to 60% by volume of the fine particles in a filler content of 70 to 90% by volume based on the volume of the whole grease. When the filler content is not less than 70% by volume, a thermal conductivity of not less than 3 W/m·K can be attained. When the filler content is less than 70% by volume, it may happen that a satisfactory thermal conductivity is not obtained. Whereas, when it exceeds 90% by volume, it may happen that no grease formation can be attained.

Surfactant

A surfactant is added to the base oil, whereby a mutual contact surface area of the inorganic powder can be increased to decrease the thermal resistance among the inorganic particles, thereby increasing the thermal conductivity of the grease, and as a result, the filler content of the inorganic powder can be increased and a suitable consistency can be obtained to maintain a satisfactory dispense property, and moreover an isolation and diffusion of the base oil can be greatly improved. A nonionic surfactant is optimum in the case where it is required to hold an electrical insulation of the grease, because the nonionic surfactant does not affect the electrical characteristics of the grease.

Examples of the nonionic surfactant are polyoxyethylene alkyl ether, polyoxyethylene alkylphenyl ether, polyoxyethylene alkylnaphthyl ether, polyoxyethylene castor oil, polyoxyethylene hardened castor oil, polyoxyethylene alkylamide, polyoxyethylene-polyoxypropylene glycol, polyoxyethylene-polyoxypropylene glycol ethylenediamine, polyoxyethylene mono-fatty acid ester, polyoxyethylene di-fatty acid ester, polyoxyethylene propylene glycol fatty acid ester, polyoxyethylene sorbitan mono-fatty acid ester, polyoxyethylene sorbitane tri-fatty acid ester, ethylene glycol mono-fatty acid ester, diethylene glycol mono-fatty acid ester, propylene glycol mono-fatty acid ester, glycerol mono-fatty acid ester, pentaerythrit mono-fatty acid ester, sorbitan mono-fatty acid ester, sorbitan sesqui-fatty acid ester and sorbitan tri-fatty acid ester.

An addition effect of the nonionic surfactant varies depending upon the kind and amount of the thermal conductive filler and an HLB value showing balance of hydrophillic and lipophillic properties. In order to obtain the grease exhibiting a satisfactory dispense property even at room temperature, it is preferable to use a liquid nonionic surfactant having an HLB of not more than 9 as the nonionic surfactant to be used in the present invention. Such a surfactant is used in a blending amount of preferably from 0.2 to 2.0% by weight based on the filler weight of the thermal conductive filler powder. When the blending amount is less than 0.2% by weight, there is a tendency that the consistency is lowered, in other words, the grease becomes hard, thereby failing to obtain a satisfactory dispense property, and moreover the mutual contact state of the particles is deteriorated to cause decrease in the thermal conductivity. On the other hand, when the blending amount exceeds 2.0% by volume, there is a tendency that the grease obtained using a solid nonionic surfactant becomes hard. With respect to a liquid nonionic surfactant, there is a tendency that a much addition effect cannot be obtained.

In using the nonionic surfactant, the surfactant may be dissolved or emulsified in the base oil. Alternatively, the surfactant may be used in a manner such that the thermal conductive filler is previously surface-treated therewith, whereby a similar effect can be obtained.

In the uses where an electrical insulation of the grease or a decrease in the electrical resistance are not so important, it is permitted to use anionic surfactants, cationic surfactants and amphoteric surfactants as well as the nonionic surfactants.

Additives

In order to improve various properties of the highly thermal conductive grease composition in accordance with the present invention, which properties include, for example, oxidation-resisting property to prevent its oxidation degradation and metal corrosion-inhibiting property, various kinds of additives can be blended therewith. Examples of the additives to be blended are antioxidants such as amine-, phenol-, sulfur- and phosphorus-based compounds which are used for inhibiting oxidation degradation; corrosion inhibitors such as benztriazole and derivatives thereof; rust preventives such as carboxylic acids, carbonates and sulfonates; thickeners such as polybutene and polymethacrylates, which are used for further improving or bettering adherability of the grease and viscosity thereof; and thickening agent such as fatty acid salts and urea compounds.

A liquation consistency is preferably within a range of from 200 to 400 at 25° C. from a viewpoint of high thermal conductivity, dispense property, flow properties and adherability of the grease and moreover inhibition of the base oil isolation. Particularly when the grease is applied to small-sized electronic components or fragile electronic components such as integrated circuit elements, more preferable is a liquation consistency of not less than 250.

Process for Producing Highly Thermal Conductive Grease Composition

The highly thermal conductive grease composition can be produced, for example, in the following manner.

The nonionic surfactant is dissolved in the base oil at room temperature or under heating, and thereafter a mixed powder prepared by blending the coarse particles and fine particles of the thermal conductive inorganic powder in a predetermined blending proportion is added thereto. The resulting mixture is pre-kneaded using a stirring rod or a stirring machine such as a planetary, a trimix and a twin-mixed mixer at room temperature or, if necessary, under heating. The pre-kneaded mixture is further kneaded under high shearing force to obtain a uniform product. Examples of a kneading machine are a three-roll and a colloid mill etc. It is preferred to carry out the kneading with the three-roll. The consistency and dispense property of the grease are sensitive to the kneading conditions such as kneading number of times and a distance between the rolls, and therefore it is necessary to study the optimum condition.

The highly thermal conductive grease composition of the present invention, which was obtained according to, for example, the above-mentioned process, can be used for utilities similar to those of a conventional thermal conductive grease composition. With respect to a cooling device in that the highly thermal conductive grease composition in accordance with the present invention intervenes between its exothermic portion and its cooling portion, thermal resistance can be remarkably decreased even when a contact surface of the grease is coarse, and as a result, stable radiation and heat diffusion can be attained to solve a miss action of electronic components, an operation suspension thereof or an accident thereto caused by accumulation of heat. Moreover, miniaturization of the cooling device and cost retrenchment can be attained.

The thermal conductive grease composition in accordance with the present invention can be applied to a contact surface between an exothermic body and a cooling body of electric and electronic components. For example, the grease can be applied to a cooling device in a power transistor, a power module, a transmission module, a rectifier and a semiconductor element of computer to improve performance of these apparatus. Further, when the grease intervenes between a thermistor or a thermo couple and a measuring portion, a satisfactory thermal conductivity can be attained to improve a measurement accuracy thereof.

The thermal conductive grease obtained in the following Examples was evaluated according to the test mentioned as follows.

1. Measurement Method of Consistency

Measurement was carried out according to the method prescribed in JIS K 2220.5.3.4. The thermal conductive grease was allowed to stand for two days after the production, then transferred in a prescribed vessel without stirring, and kept at 25° C. Thereafter, the liquation consistency thereof was measured.

2. Test Method of Base Oil Diffusion

The test method is as shown in FIG. 1. The grease was attached to the tip of an injector. About 0.2 g of the grease 1 was coated in a circular and gable room form on an aluminum nitride plate 2 (0.5 mm thick, 50×50 mm) having a surface coarseness (Ra) of 2 $\mu$m. The plate was fixed in a thermostat of 120° C. for 50 hours, and thereafter a diffusion width (mm) of the diffusion portion 3 of the bleeding base oil was calculated by the following equation (2).

$$\text{Width of diffused oil} = (\text{diameter of bleeding} - \text{diameter of grease coated})/2 \quad (2)$$

3. Measurement Method of Thermal Conductivity

Thermal conductivity of the grease was measured according to a stationary method. That is, the sample was placed between a copper-made column like heating portion and a copper-made columnar cooling portion, and respective temperatures of the heating portion and the cooling portion were measured. The thermal conductivity of the sample placed between those was measured based on a temperature gradient, provided that respective temperatures were measured with a thermo couple buried in the heating portion and the cooling portion. Incidentally, the heat flow was determined from a temperature gradient and section area of the copper-made column. The thermal conductivity $\lambda$ of the sample was calculated according to the following equation (3), provided that a high temperature end in the temperature of the heating portion and a low temperature end in the temperature of the cooling portion were assigned to be TH and TL, respectively.

$$\lambda=\{(QH+QL)/2\times L\}/A\times(TH-TL) \quad (3)$$

QH: heat flow at high temperature side block (heating portion), QL: heat flow at low temperature side block (cooling portion), A: section area of contact portion of sample, L: thickness of sample, TH: temperature at high temperature side block, and TL: temperature at low temperature side block.

The thermal conductive grease composition in accordance with the present invention was obtained in the following manner. To a predetermined amount of a base oil in which a predetermined amount of a nonionic surfactant had been dissolved under heating, was added a predetermined amount of a mixed powder prepared by combining coarse particles and fine particles of a thermal conductive inorganic powder. The resulting mixture was stirred with a stirring rod at room temperature or under heating to 50 to 100° C. to finish a pre-kneading, followed by cooling to room temperature. The mixture pre-kneaded was kneaded five times using a three-roll milling machine, in which distances among the rolls were adjusted to a first stage: 150 μm and a second stage: 80 μm, respectively, thereby obtaining the desired thermal conductive grease composition.

EXAMPLES

The present invention is illustrated in more detail with reference to Examples, which are not to be construed as limiting the scope of the present invention.

Examples 1 to 10

The thermal conductive grease compositions were obtained using the materials mentioned below, provided that viscosity of the base oil and a filler content of the inorganic powder were varied, and then their thermal conductivity and liquation consistency were measured.

(1) Nonionic surfactant: decaglyceline fatty acid ester, i.e. decaglyceryl pentaoleate (Decaglyn 5-O (HLB: 3.5), manufactured by Nikko Chemicals Ltd.), 1% by weight based on the weight of the inorganic powder.

(2) Base oil: poly-α-olefin (SHF Series, manufactured by Mobil Chemical Co.), viscosity: 5.8 to 500 $mm^2$/sec.

(3) Inorganic powder: zinc oxide powder, mixed powder prepared by combining coarse particles having an average particle size of 12.7 μm and fine particles having an average particle size of 0.76 μm, i.e. one seventeenth of that of the coarse particles in a blending proportion by volume of coarse particles 60: fine particles 40, filler content: 60 to 90% by volume.

With respect to the obtained thermal conductive grease compositions, their thermal conductivity and liquation consistency were measured. The results are as shown in Table 1.

TABLE 1

| Example | Base oil (Surfactant added) ($mm^2$/s, | Thermal conductivity (W/m · K) Filler content of mixed powder (vol %) | | | | | | | Liquation consistency (at 25° C.) Filler content of mixed powder (vol %) | | | | | | |
|---|---|---|---|---|---|---|---|---|---|---|---|---|---|---|---|
| No. | at 40° C.) | 60 | 70 | 75 | 80 | 85 | 87 | 90 | 60 | 70 | 75 | 80 | 85 | 87 | 90 |
| 1 | 5.8 | 2.45 | 3.05 | 3.40 | 4.28 | 5.02 | 5.63 | 6.01 | >420 | >420 | >420 | 400 | 340 | 311 | 290 |
| 2 | 8.8 | 2.30 | 3.07 | 3.39 | 4.21 | 5.07 | 5.65 | 6.02 | >420 | 419 | 390 | 355 | 336 | 287 | 266 |
| 3 | 15.0 | 2.44 | 3.01 | 3.37 | 4.20 | 5.05 | 5.60 | 6.01 | >420 | 410 | 387 | 348 | 310 | 276 | 244 |
| 4 | 30.0 | 2.31 | 3.12 | 3.27 | 4.10 | 4.95 | 5.41 | | 400 | 375 | 359 | 312 | 252 | 218 | |
| 5 | 47.0 | 2.34 | 3.16 | 3.28 | 3.99 | 5.01 | 5.35 | | 385 | 370 | 349 | 269 | 247 | 210 | |
| 6 | 68.0 | 2.31 | 3.16 | 3.27 | 4.05 | 4.98 | 5.36 | | 378 | 347 | 323 | 251 | 236 | 200 | |
| 7 | 209 | 2.20 | 3.20 | 3.47 | 4.05 | 4.95 | 5.40 | | 360 | 320 | 289 | 245 | 224 | 155 | |
| 8 | 400 | 2.26 | 3.25 | 3.45 | 3.99 | 4.99 | 5.35 | | 350 | 315 | 255 | 240 | 210 | 142 | |
| 9 | 450 | 2.18 | 3.20 | 3.48 | Grease formation | | | | 328 | 243 | 205 | Grease formation | | | |
| 10 | 500 | 2.37 | 3.12 | 3.27 | impossible | | | | 302 | 227 | 175 | impossible | | | |

Mixed powder: Blending proportion (%) of coarse particles (12.7 μm) and fine particles (0.76 μm); 40:60

As can be seen from the results of Examples 1 to 10, in some cases of combinations which are high in both the viscosity of the base oil and the filler content of the inorganic powder, no grease formation can be attained, but in the remaining cases where the desired grease formation can be attained, both the thermal conductivity and the liquation consistency can be increased with the aid of the nonionic surfactant of decaglyceryl pantaoleate. Thus, soft greases having a good thermal conductivity were obtained and they had a good dispense property.

Further in Examples 1 to 10, zinc oxide was used as the inorganic powder, and therefore the obtained thermal conductive grease is superior in its electrical insulation, so that the grease can be applied to components for electric and electronic apparatus.

Figure 2:
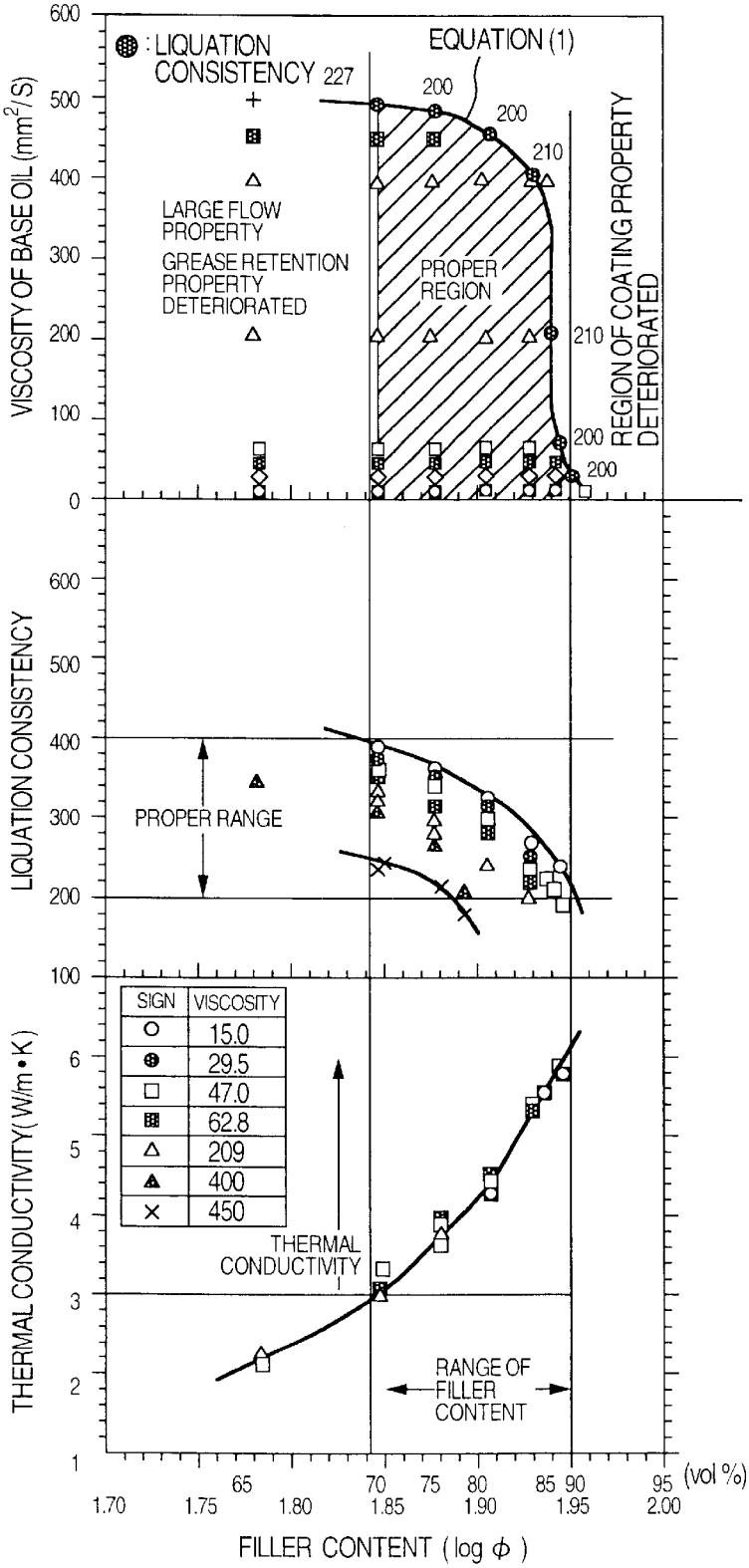
FIG. 2 is a drawing to show relations among a filler content of the inorganic powder and a thermal conductivity and liquation consistency of the grease.

In FIG. 2, there are shown relations among the filler content of the mixed powder, the thermal conductivity (3 W/m·K or more) and liquation consistency of the thermal conductive grease composition, when the viscosity of the base oil is within a range of from 15 $mm^2$/sec to 450 $mm^2$/sec. As can be seen from said relations, almost regardless of the viscosity of the base oil, the thermal conductivity tends to be increased with increase in the filler content of the inorganic powder, allowing of some exception. On the other hand, the liquation consistency depends on the viscosity of the base oil. From Table 1 and FIG. 2, it is found that there can be obtained grease having a liquation consistency of from 200 to 400 and a thermal conductivity of 3 W/m·K or more, which conditions are to attain a satisfactory dispense property and a high thermal conductivity, when the filler content of the inorganic powder is not less than 70% by volume. In this case, the viscosity of the base oil may be within a range of from 15 to 450 $mm^2$/sec. Furthermore, it was found that the filler content $\phi$ (% by volume) of the mixed powder and the viscosity $\eta$ ($mm^2$/sec) of the base oil at 40° C. can be expressed by the following expression (1).

$$\text{Log}\ \phi \leqq -1\times10^{-18}\times(\eta-250)^5+1.9345 \quad (1)$$

Furthermore, in a conventional grease, the liquation consistency is decreased with increase in the filler content of the inorganic powder, thereby resulting in a hard grease of an unsatisfactory dispense property. On the other hand, in Examples 1 to 10, the value of liquation consistency was not so largely decreased even if the filler content was increased.

Comparative Examples 1 to 10

For the comparison purpose with Examples 1 to 10, respective grease comprising 10 to 40% by volume of a poly-α-olefin base oil (SKF Series, manufactured by Mobil Chemical Company) were obtained with use of no nonionic surfactant. The results are shown in Table 2.

TABLE 2

| Comparative Example No. | Base oil (No surfactant) ($mm^2/s$, at 40° C.) | Thermal conductivity (W/m · K) Filler content of mixed powder (vol %) | | | | | | Liquation consistency (at 25° C.) Filler content of mixed powder (vol %) | | | | | |
|---|---|---|---|---|---|---|---|---|---|---|---|---|---|
| | | 60 | 70 | 80 | 85 | 87 | 90 | 60 | 70 | 80 | 85 | 87 | 90 |
| 1 | 5.8 | 1.14 | Grease formation impossible | | | | | 90 | Grease formation impossible | | | | |
| 2 | 8.8 | 1.18 | | | | | | 87 | | | | | |
| 3 | 18.0 | 1.12 | | | | | | 85 | | | | | |
| 4 | 30.0 | 1.76 | | | | | | 84 | | | | | |
| 5 | 47.0 | 1.79 | | | | | | 81 | | | | | |
| 6 | 68.0 | 1.88 | | | | | | 86 | | | | | |
| 7 | 209 | 1.87 | | | | | | 73 | | | | | |
| 8 | 400 | 1.66 | 1.34 | | | | | 75 | 25 | | | | |
| 9 | 450 | 1.60 | 1.42 | | | | | 64 | 36 | | | | |
| 10 | 500 | 1.54 | 1.46 | | | | | 64 | 42 | | | | |

As can be seen from the results of Comparative Examples 1 to 10, no grease formation can be attained in most of combinations, and even in some cases where the grease formation can be attained, both the thermal conductivity and the liquation consistency are lower than those of Examples 1 to 10, and neither a satisfactory dispense property nor a high thermal conductivity is attained.

Examples 11 to 23

Using materials mentioned below, thermal conductive grease compositions comprising 25% by volume of a base oil and 75% by volume of an inorganic powder were obtained, provided that a kind of the base oil was varied, and then the thermal conductivity, liquation consistency and diffusion width of the base oil caused by bleeding were measured. A mixing ratio of the mixed base oil was 50:50.

(1) Nonionic surfactant: decaglyceryl pentaoleate, 1% by weight based on the weight of the inorganic powder.

(2) Inorganic powder: zinc oxide powder, base oil: inorganic powder=25% by volume: 75% by volume, mixed powder prepared by combining coarse particles having an average particle size of 12.7 μm and fine particles having an average particle size of 0.76 μm, i.e. one seventeenth of that of the coarse particles in a blending proportion by volume of coarse particles 60: fine particles 40.

(3) Mineral oil: that manufactured by Cosmo Oil Lubricant Ltd.

(4) Synthetic oil: diester manufactured by Asahi Denka Ltd, plyol ester manufactured by Asahi Denka Ltd., trimellitic acid ester manufactured by Asahi Denka Ltd., alkyl diphenyl ether manufactured by Matsumura Oil Research Corp., polyphenyl ether manufactured by Matsumura Oil Research Corp., polybutene manufactured by Nippon Mitsubishi Oil Corp., or fluoro-oil manufactured by Ausimont Ltd.

Measurements results are as shown in Table 3.

TABLE 3

| Example No. | Base oil (Surfactant added) | Product Name | Viscosity of base oil ($mm^2/s$, at 40° C.) | Liquation consistency (at 25° C.) | Thernal conductivity (W/m · K) | Diffusion width (mm) |
|---|---|---|---|---|---|---|
| 11 | Mineral oil | N-500 | 94 | 330 | 3.24 | 3.1 |
| 12 | Diester | Adekasin 2050 | 26 | 370 | 3.13 | 3.9 |
| 13 | Poly-α-olefin | SHC230 | 209 | 289 | 3.47 | 3.1 |
| 14 | Polyol ester | Blueper H-450 | 383 | 312 | 3.23 | 3.6 |
| 15 | Trimellitic acid ester | Blueper T-120 | 130 | 320 | 3.23 | 3.3 |
| 16 | Polybutene | LZV100 | 205 | 285 | 3.19 | 3.1 |
| 17 | Alkyl diphenyl ether | LA100 | 102 | 305 | 3.20 | 3.1 |
| 18 | Polyphenyl ether | S-3230 | 410 | 285 | 3.16 | 3.1 |
| 19 | Fluoro-oil | Fomblin Y45 | 210 | 295 | 3.47 | 3.3 |
| 20 | Mineral oil + Diester | | 60 | 320 | 3.20 | 3.4 |
| 21 | Polyol ester + Trimellitic acid ester | | 256 | 295 | 3.24 | 3.3 |
| 22 | Alkyl diphenyl ether + | | 116 | 323 | 3.22 | 3.2 |

TABLE 3-continued

| Example No. | Base oil (Surfactant added) | Product Name | Viscosity of base oil ($mm^2/s$, at 40° C.) | Liquation consistency (at 25° C.) | Thernal conductivity (W/m · K) | Diffusion width (mm) |
|---|---|---|---|---|---|---|
| 23 | Polyol ester<br>Polyol ester + Polyphenyl ether | | 396 | 278 | 3.21 | 3.2 |

With the aid of decaglyceryl pentaoleate, there could be obtained grease which were high in both the thermal conductivity and the liquation consistency and which were satisfactory in its thermal conductive property and its dispense property. As can be seen from the results, the diffusion width of the base oil due to bleeding is small, and it is apparent that the surfactant serves to control the isolation of the base oil from the grease regardless the kind of the base oil.

Comparative Examples 11 to 23

For the comparison purpose with Examples 11 to 23, there were obtained respective grease blended with no nonionic surfactant. Measurements results are as shown in Table 4.

TABLE 4

| Comparative Example No. | Base oil (No Surfactant) | Product Name | Viscosity of base oil ($mm^2/s$, at 40° C.) | Liquation consistency (at 25° C.) | Thernal conductivity (W/m · K) | Diffusion width (mm) |
|---|---|---|---|---|---|---|
| 11 | Mineral oil | N-500 | 94 | Grease formation impossible | | |
| 12 | Diester | Adekasin 2050 | 26 | | | |
| 13 | Poly-α-olefin | SHC230 | 209 | | | |
| 14 | Polyol ester | Blueper H-450 | 383 | 190 | 2.64 | 4.3 |
| 15 | Trimellitic acid ester | Blueper T-120 | 130 | Grease formation impossible | | |
| 16 | Polybutene | LV100 | 205 | 195 | 2.31 | 4.7 |
| 17 | Alkyl diphenyl ether | LA100 | 102 | Grease formation impossible | | |
| 18 | Polyphenyl ether | S-3230 | 410 | 195 | 2.41 | 4.6 |
| 19 | Fluoro-oil | Fomblin Y45 | 210 | 276 | 3.21 | 7.6 |
| 20 | Mineral oil + Diester | — | 60 | Grease formation impossible | | |
| 21 | Polyol ester + Trimellitic acid ester | — | 256 | 153 | 2.11 | 4.0 |
| 22 | Alkyl diphenyl ether + Polyol ester | — | 116 | Grease formation impossible | | |
| 23 | Polyol ester + Polyphenyl ether | — | 396 | 183 | 2.45 | 4.8 |

In Comparative Examples 11 to 23, it is difficult to attain a grease formation depending upon the kind of the base oil, and even in the case where the grease formation can be attained, the liquation consistency and the thermal conductivity are low, and therefore neither a satisfactory dispense property nor a high thermal conductivity is attained. In addition, the diffusion width of the base oil due to bleeding is larger than those in Examples 11 to 23, and the base oil is easier to be isolated from the grease than those in Examples 11 to 23.

Figure 3:
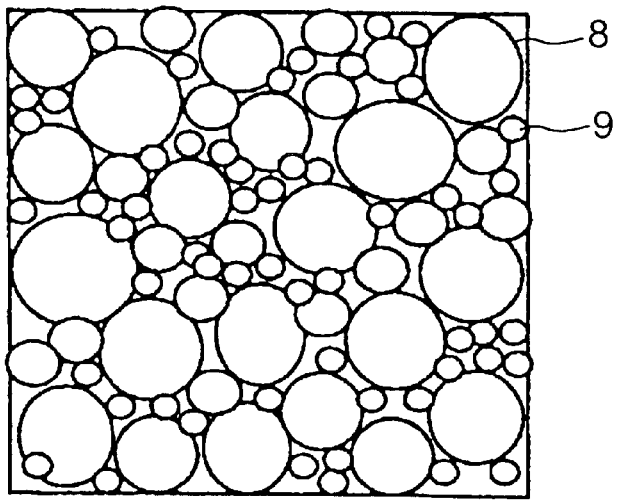
FIG. 3 is a drawing to show a dispersion model of the inorganic powder in the case where a surfactant is added.
Figure 4:
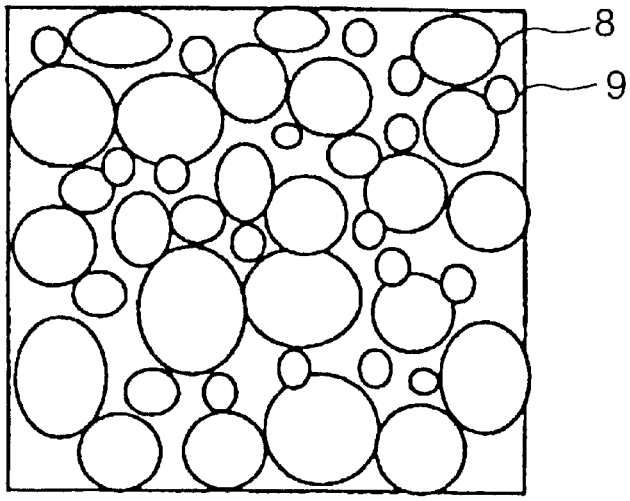
FIG. 4 is a drawing to show a dispersion model of the inorganic powder in the case where no surfactant is added.

In FIG. 3, there is shown a dispersion model of the inorganic powder in the case where the surfactant is added. In FIG. 4, there is shown a dispersion model of the inorganic powder in the case where no surfactant is added.

From the dispersion model shown in FIG. 3, the fine particles 9 easily enter the voids among the coarse particles 8 with the aid of the surfactant, and as a result, a high filler content of the inorganic powder can be attained. Further, flow of the particles becomes smooth, and therefore a high liquation consistency is attained, in other words, there can be obtained a soft grease. Furthermore, a large quantity of the fine particles 9 enters the voids among the coarse particles 8, and as a result, a mutual contact surface area of the particles increases to decrease the thermal resistance among the particles, whereby there can be obtained a highly thermal conductive grease.

A most of the base oil is held in the void portions among the particles by a capillary phenomenon. A fine void portions increase with the aid of an addition of the surfactant, and the base oil is held in the resulting fine void portions. As a result, the diffusion width of the base oil due to bleeding of the base oil is decreased, in other words, the isolation of the base oil can be controlled.

In the dispersion model shown in FIG. 4, wherein no surfactant is added, it is difficult that the fine particles 9 enter the voids among the coarse particles 8. As a result, there are left many voids among the powder particles, and a mutual contact surface area of the particles is decreased to increase the thermal resistance among the particles, thereby decreasing the thermal conductivity of the grease. The particles are difficult to flow and therefore the liquation of consistency becomes small, in other words, the grease becomes hard. Further, the void portions among the particles are larger in comparison with the case where the surfactant is used, and therefore the base oil cannot be held in the void portions and easily bleeds out.

Examples 24 to 62

Using materials mentioned below, thermal conductive grease compositions were obtained, provided that the base oils different in viscosity (47.0 $mm^2/s$ and 400 $mm^2/s$) were used and a ratio of an average particle size of coarse particles Pl and that of fine particles Ps, Pl/Ps, was varied within a range of from ⅓ (one third) to 1/54 (one fifty-fourth). The thermal conductivity and liquation consistency thereof were measured. The filler content of the inorganic powder was varied within a range of from 75 to 89% by volume.

(1) Nonionic surfactant: decaglyceryl pentaoleate, 1% by weight based on the weight of inorganic powder.

(2) Base oil: poly-α-olefin, viscosity: 47.0 $mm^2/s$ or 400 $mm^2/s$.

(3) Inorganic powder: zinc oxide powder, filler content: 75 to 89% by volume, mixed powder prepared by combining coarse particles having an average particle size of from 5.4 to 16.3 μm and fine particles having an average particle size of from 0.3 to 4.2 μm in a ratio of an average particle size of coarse particles P1 and that of fine particles Ps, P1/Ps, within a range of from ⅓ to 1/54 in a blending proportion by volume of coarse particles: fine particles=40 to 100:0 to 60.

The measurement results are as shown in Table 5

TABLE 5

| | Combination of fine particles and coarse particles and blending proportion thereof (% by vol.) | | | | | | | | | | | |
|---|---|---|---|---|---|---|---|---|---|---|---|---|
| | Average particle size of fine particles (Ps μm) | | | | | | | Average particle size of coarse particles (Pl μm) | | | | |
| | 0.3 | 0.4 | 0.6 | 0.7 | 1.8 | 3.8 | 4.2 | 5.4 | 11.6 | 12.7 | 13.1 | 16.3 |
| | Range of particle size | | | | | | | | | | | |
| Example No. | <2.63 | 0.24~2.31 | 0.29~5.50 | 0.17~3.37 | 0.29~6.54 | 0.17~14.9 | 0.41~9.25 | 0.17~14.9 | 4.62~37.0 | 5.50~37.0 | 3.73~41.0 | 7.78~49.8 |
| 24 | | | | 0 | | | | 100 | | | | |
| 25 | | | | 5 | | | | 95 | | | | |
| 26 | | | | 10 | | | | 90 | | | | |
| 27 | | | | 30 | | | | 70 | | | | |
| 28 | | | | 50 | | | | 50 | | | | |
| 29 | | | | 60 | | | | 40 | | | | |
| 30 | | | | 0 | | | | | | | 100 | |
| 31 | | | | 5 | | | | | | | 95 | |
| 32 | | | | 10 | | | | | | | 90 | |
| 33 | | | | 30 | | | | | | | 70 | |
| 34 | | | | 50 | | | | | | | 50 | |
| 35 | | | | 60 | | | | | | | 40 | |
| 36 | | | | 20 | | | | 80 | | | | |
| 37 | | | | 20 | | | | | | 80 | | |
| 38 | | | | 20 | | | | | | | | 80 |
| 39 | | | | 40 | | | | | | 60 | | |
| 40 | | | | | 40 | | | | | 60 | | |
| 41 | | | | | | 40 | | | | 60 | | |
| 42 | | | | | | | 40 | | | 60 | | |
| 43 | | | | | 40 | | | | | | | 60 |
| 44 | | | | | | 40 | | | | | | 60 |
| 45 | | | 40 | | | | | | | 60 | | |
| 46 | | | 40 | | | | | | | | | 60 |
| 47 | | | | | 40 | | | | | | | 60 |
| 48 | 40 | | | | | | | | | 60 | | |
| 49 | | 40 | | | | | | | | 60 | | |
| 50 | 40 | | | | | | | | | | | 60 |
| 51 | | 40 | | | | | | | | | | 60 |
| 52 | | | 30 | | | | | | | 70 | | |
| 53 | | | 30 | | | | | | | | | 70 |
| 54 | | | 30 | | | | | | | 70 | | |
| 55 | | | 30 | | | | | | | 70 | | |
| 56 | 30 | | | | | | | | | 70 | | |
| 57 | | | 30 | | | | | | 70 | | | |
| 58 | | 30 | | | | | | | 70 | | | |
| 59 | | 6 | | 37 | | | | | | 57 | | |
| 60 | | 6 | | | 37 | | | | | 57 | | |
| 61 | | 6 | | 37 | | | | | | | | 57 |
| 62 | | 6 | | | | 37 | | | | | | 57 |

| Example No. | Pl/Ps | Filler content of mixed powder (vol. %) | Viscosity of base oil ($mm^2/s$) | Liquation consistency (at 25° C.) | Thermal conductivity (W/m · K) |
|---|---|---|---|---|---|
| 24 | — | 75 | 400 | 290 | 2.55 |
| 25 | 1/8 | | | 285 | 2.60 |
| 26 | | | | 281 | 3.00 |
| 27 | | | | 269 | 3.71 |
| 28 | | | | 241 | 3.12 |
| 29 | | | | 228 | 3.05 |
| 30 | — | | | 277 | 2.60 |
| 31 | 1/19 | | | 290 | 2.87 |
| 32 | | | | 280 | 3.03 |

TABLE 5-continued

| | | | | | |
|---|---|---|---|---|---|
| 33 | 1/19 | 75 | 400 | 255 | 3.64 |
| 34 | | | | 230 | 3.43 |
| 35 | | | | 221 | 3.21 |
| 36 | 1/8 | 80 | 47.0 | 330 | 3.31 |
| 37 | 1/18 | 85 | | 233 | 5.01 |
| 38 | 1/23 | | | 240 | 5.24 |
| 39 | 1/18 | 80 | | 312 | 4.47 |
| 40 | 1/7 | 85 | | 310 | 4.56 |
| 41 | 1/3 | | | 320 | 4.31 |
| 42 | 1/4 | | | 316 | 4.47 |
| 43 | 1/16 | | | 310 | 5.15 |
| 44 | 1/5 | | | 269 | 5.31 |
| 45 | 1/21 | | | 252 | 5.32 |
| 46 | 1/27 | | | 241 | 5.18 |
| 47 | 1/16 | 86 | | 220 | 5.52 |
| 48 | 1/42 | 85 | 47.0 | Grease formation impossible | |
| 49 | 1/8 | | | 215 | 4.22 |
| 50 | 1/54 | | | Grease formation impossible | |
| 51 | 1/41 | | | 205 | 5.11 |
| 52 | 1/21 | | | 245 | 5.36 |
| 53 | 1/27 | | | 250 | 5.34 |
| 54 | 1/21 | 87 | | 215 | 5.77 |
| 55 | | 88 | | 200 | 5.34 |
| 56 | | 89 | | Grease formation impossible | |
| 57 | 1/19 | 85 | | 246 | 5.25 |
| 58 | 1/29 | | | 240 | 5.33 |
| 59 | 1/7~32 | | | 264 | 5.09 |
| 60 | 1/3~32 | | | 256 | 4.55 |
| 61 | 1/9~41 | | | 260 | 5.34 |
| 62 | 1/4~41 | | | 255 | 5.05 |

In the case where there are combined coarse particles having an average particle size of from 11.6 to 16.3 μm and fine particles having an average particle size of from 0.4 to 5.4 μm, which is from ⅓ to 1/41 times that of the coarse particles, and there are adjusted the blending proportions by volume within a range of from 40 to 90:60 to 10, a thermal conductive grease having a thermal conductivity as high as from 3.0 to 5.77 W/m·K and a satisfactory dispense property can be obtained.

Further, as can be seen in Examples 59 to 62, a satisfactory dispense property and a high thermal conductivity can be attained by combining two kinds of fine particles. Even when the average particle size of the coarse particles is within a range of from 10 to 20 μm, similar tendency can be obtained. Incidentally, in Examples 46, 48 and 54 wherein fine particles having an average particle size of not more than 0.3 μm were combined, no grease formation could be attained in spite of carrying out the kneading with a three-roll.

Examples 63 to 89

Comparative Example 24

Using the materials mentioned below, respective thermal conductive grease were obtained to evaluate the addition effect of various nonionic surfactants in terms of the liquation consistency and thermal conductivity of the grease.

(1) Nonionic surfactant: various surfactants as shown in Table 6, 1% by weight.

(2) Base oil: poly-α-olefin, viscosity at 40° C.: 400 $mm^2/s$, 30% by volume.

(3) Inorganic powder: zinc oxide powder, coarse particles of average particle size; 3.83 μm, filler content: 30% by volume.

The grease obtained by blending no nonionic surfactant was assigned to be Comparative Example 24. The measurement results are as shown in Table 6.

TABLE 6

| Example No. | Classification of surfactant | Chemical name (Commercial name) | HLB | Liquation consistency (at 25° C.) | Thermal conductivity (W/m · K) |
|---|---|---|---|---|---|
| 63 | Sorbitan fatty acid ester | Sorbitan monolaurate (SL-101) | 8.6 | 205 | 3.15 |
| 64 | | Sorbitan palmitate (SP-10) | 6.7 | 245 | — |
| 65 | | Sorbitan monoisostearate (SI-10R) | 5.0 | 350 | 3.30 |
| 66 | | Sorbitan sesquiisostearate (SI-15R) | 4.5 | 348 | 3.31 |
| 67 | | Sorbitan monostearate (SS-10) | 4.7 | 269 | 3.17 |
| 67 | | Sorbitan trioleate (SO-30) | 1.7 | 300 | — |
| 68 | | Sorbitan tritol oil fatty acid ester (SR-30) | 1.7 | 311 | 3.25 |
| 69 | Decaglycerol fatty acid ester | Glyceryl monoisostearate (MGIS) | 4.0 | 340 | — |
| 70 | | Decaglyceryl dioleate (Decaglyn 2-O) | 10.0 | 123 | 3.02 |
| 71 | | Decaglyceryl distearate (Decaglyn 2-S) | 9.5 | 152 | 3.01 |

TABLE 6-continued

| Example No. | Classification of surfactant | Chemical name (Commercial name) | HLB | Liquation consistency (at 25° C.) | Thermal conductivity (W/m · K) |
|---|---|---|---|---|---|
| 72 | | Decaglyceryl trioleate (Decaglyn 3-O) | 7.0 | 338 | — |
| 73 | | Decaglyceryl pentaisostearate (Decaglyn 5-IS) | 3.5 | 362 | 3.36 |
| 74 | | Diglyceryl monoisostearate (DGMIS) | 5.5 | 364 | — |
| 75 | | Decaglyceryl pentaoleate (Decaglyn 5-0) | 3.5 | 370 | 3.32 |
| 76 | Propylene glycol, | Propylene glycol monostearate (PMS-1C) | 3.5 | 310 | — |
| 77 | pentaerythritol fatty acid ester | Pentaerythritol stearate (PEMS) | 2.0 | 349 | 3.33 |
| 78 | Polyoxyethylene | Polyoxyethylene sorbit hexastearate (GS-6) | 3.0 | 245 | — |
| 79 | sorbit fatty acid ester | Polyoxyethylene sorbot tetraoleate (GO-4) | 8.5 | 210 | 3.26 |
| 80 | Polyoxyethylene | Polyoxyethylene glyceryl monostearate (TMGS-5) | 9.5 | 195 | — |
| 81 | glycerol fatty acid ester | Polyethylene glycerol animal fatty acid ester (TGL-0306) | 7.0 | 245 | 3.27 |
| 82 | Polyethylene glycol fatty acid ester | Polyoxyethylene monostearate (MYS-1EX) | 2.0 | 310 | 3.32 |
| 83 | | Polyoxyethylene monooleate (MYO- 2) | 4.5 | 275 | — |
| 84 | | Polyethylene glycol distearate (CDS-400) | 8.5 | 200 | 3.11 |
| 85 | Polyoxyethylene alkyl ether | Polyoxyethylene stearyl ether (BS-2) | 8.0 | 205 | 3.05 |
| 86 | Polyoxyethylene phenyl ether | Polyoxyethylene nonylphenyl ether (NP-2) | 4.5 | 241 | 3.21 |
| 87 | | Polyoxyethylene octylphenyl ether (OP-3) | 6.0 | 354 | — |
| 88 | Polyoxyethylene castor oil, | Polyoxyethylene castor oil (CO-3) | 3.0 | 260 | 3.26 |
| 89 | hardened castor oil | Polyoxyethylene hardened castor oil (HCO-5) | 6.0 | 223 | — |
| Comp. Ex. 24 | — | None | — | 32 | 3.11 |

* Inorganic powder: Zinc oxide having average particle size of 3.83 μm, 70% by vol.

As is clear from the results shown in Table 6, the nonionic surfactant serves to improve dispersibility of the zinc oxide powder. When the HLB value representing a balance of hydrophilic property and lipophilic property is not more than 9, the effect is remarkable, so that the liquation consistency becomes not less than 200 (the grease being greatly softened) to attain a high filler content of the powder. For that reason, the thermal conductivity can be remarkably improved.

Examples 90 to 117

Comparative Example 25

Using the materials mentioned below, respective thermal conductive grease were obtained to evaluate the addition effect of various nonionic surfactants in terms of the liquation consistency and thermal conductivity of the grease.

(1) Nonionic surfactant: those shown in Table 7, 1% by weight based on the weight of the inorganic powder.

(2) Base oil: poly-α-olefin, viscosity at 40° C.: 400 $mm^2/s$, 30% by volume.

(3) Inorganic powder: aluminum nitride powder, average particle size: 13.3 μm, filler content: 70% by volume.

The grease obtained by blending no nonionic surfactant was assigned to be Comparative Example 25. The measurement results are as shown in Table 7. Various nonionic surfactants shown in Table 7 are the same as those shown in Table 6.

TABLE 7

| Example No. | Classification of surfactant | Chemical name (Commercial name) | HLB | Liquation consistency (at 25° C.) | Thermal conductivity (W/m · K) |
|---|---|---|---|---|---|
| 90 | Sorbitan fatty | Sorbitan monolaurate (SL-101) | 8.6 | 219 | 3.21 |
| 91 | acid ester | Sorbitan palmitate (SP-10) | 6.7 | 212 | — |
| 92 | | Sorbitan monoisostearate (SI-10R) | 5.0 | 375 | 3.35 |
| 93 | | Sorbitan sesquiisostearate (SI-15R) | 4.5 | 400 | 3.33 |
| 94 | | Sorbitan monostearate (SS-10) | 4.7 | 209 | 3.19 |
| 95 | | Sorbitan trioleate (SO-30) | 1.7 | 280 | — |

TABLE 7-continued

| Example No. | Classification of surfactant | Chemical name (Commercial name) | HLB | Liquation consistency (at 25° C.) | Thermal conductivity (W/m · K) |
|---|---|---|---|---|---|
| 96 | Decaglycerol fatty acid ester | Sorbitan tritol oil fatty acid ester (SR-30) | 1.7 | 314 | 3.28 |
| 97 | | Glyceryl monoisostearate (MGIS) | 4.0 | 300 | — |
| 98 | | Decaglyceryl dioleate (Decaglyn 2-O) | 10.0 | 135 | 3.10 |
| 99 | | Decaglyceryl distearate (Decaglyn 2-S) | 9.5 | 175 | 3.16 |
| 100 | | Decaglyceryl trioleate (Decaglyn 3-O) | 7.0 | 364 | — |
| 101 | | Decaglyceryl pentaisostearate (Decaglyn 5-IS) | 3.5 | 385 | 3.29 |
| 102 | | Diglyceryl monoisostearate (DGMIS) | 5.5 | 390 | — |
| 103 | | Decaglyceryl pentaoleate (Decaglyn 5-O) | 3.5 | 380 | 3.36 |
| 104 | Propylene glycol, pentaerythritol fatty acid ester | Propylene glycol monostearate (PMS-1C) | 3.5 | 378 | — |
| 105 | | Pentaerythritol stearate (PEMS) | 2.0 | 369 | 3.38 |
| 106 | Polyoxyethylene sorbit fatty acid ester | Polyoxyethylene sorbit hexastearate (GS-6) | 3.0 | 233 | — |
| 107 | | Polyoxyethylene sorbot tetraoleate (GO-4) | 8.5 | 229 | 3.36 |
| 108 | Polyoxyethylene glycerol fatty acid ester | Polyoxyethylene glyceryl monostearate (TMGS-5) | 9.5 | 187 | — |
| 109 | | Polyoxyethylene glycerol animal fatty acid ester (TGL-0306) | 7.0 | 221 | 3.29 |
| 110 | Polyethylene glycol fatty acid ester | Polyoxyethylene monostearate (MYS-1EX) | 2.0 | 400 | 3.34 |
| 111 | | Polyoxyethylene monooleate (MYO-2) | 4.5 | 410 | — |
| 112 | | Polyethylene glycol distearate (CDS-400) | 8.5 | 390 | 3.31 |
| 113 | Polyoxyethylene alkyl ether | Polyoxyethylene stearyl ether (BS-2) | 8.0 | 385 | 3.25 |
| 114 | Polyoxyethylene phenyl ether | Polyoxyethylene nonylphenyl ether (NP-2) | 4.5 | 379 | — |
| 115 | | Polyoxyethylene octylphenyl ether (OP-3) | 6.0 | 386 | 3.28 |
| 116 | Polyoxyethylene castor oil, hardened castor oil | Polyoxyethylene castor oil (CO-3) | 3.0 | 378 | — |
| 117 | | Polyoxyethylene hardened castor oil (HCO-5) | 6.0 | 376 | 3.35 |
| Comp. Ex. 25 | | None | — | 55 | 3.22 |

* Inorganic powder: Aluminum nitride having average particle size of 13.3 μm, 70% by vol.

As is clear from the results shown in Table 7, the nonionic surfactants in accordance with the present invention serves to increase the liquation consistency even in the case of using aluminum nitride powder like in the results of Examples 62 to 84. Also like in Examples 62 to 84, when the HLB value is not more than 9, a high filler content of the aluminum nitride powder can be attained to improve the thermal conductivity remarkably.

However, since the grease of Examples 63 to 89 (Table 6) and those of Examples 90 to 117 (Table 7) were obtained using the inorganic powder having one kind of the average particle size, those grease exhibit the liquation consistency almost equal to that of the grease shown in Table 1, Table 5 and Table 9 which is mentioned below, while those grease exhibit thermal conductivity of not more than 3.4, which is somewhat inferior to those obtained using the inorganic powder having two kinds of the average particle size.

Examples 118 to 123

Using the materials mentioned below, respective thermal conductive grease were obtained to study the addition effect of the nonionic surfactant. The measurement results are as shown in Table 8.

(1) Nonionic surfactant: those shown in Table 8, blending amounts shown in Table 8 (% by weight).

(2) Base oil: poly-α-olefin, viscosity at 40° C.: 400 $mm^2/s$, 20% by volume.

(3) Inorganic powder: aluminum nitride power, filler content: 80% by volume, mixed powder prepared by combining coarse particles having an average particle size of 12.7 μm and fine particles having an average particle size of 0.7 μm in a blending proportion by volume of coarse particles: fine particles=60:40.

TABLE 8

| Example No. | Classification type/Chemical name (Commercial name) | Liquation consistency Blending proportion based on the weight of mixed powder of zinc oxide (% by wt.) 0 | 0.1 | 0.2 | 0.5 | 1.0 | 1.5 | 2.0 | 2.5 |
|---|---|---|---|---|---|---|---|---|---|
| 118 | Sorbitane fatty acid ester type/Sorbitane trioleate (SO-30) | 55 (3.04) | 142 (3.64) | 230 (4.44) | 295 | 330 (4.39) | 331 | 330 (4.40) | 315 (4.41) |
| 119 | Decaglycerol fatty acid ester type/Decaglyceryl pentaoleate (Decaglyn 5-O) | | 163 (3.55) | 250 (4.49) | 313 | 325 (4.45) | 322 | 325 (4.46) | 330 (4.46) |
| 120 | Polyoxyethylene sorbit fatty acid ester type/ Polyoxyethylene sorbit hexastearate (GS-6) | | 145 (3.46) | 220 (4.34) | 281 | 348 (4.48) | 355 | 356 (4.49) | 320 (4.50) |
| 121 | Polyoxyethylene alkyl ether type/Polyoxyethylene oleyl ether (BO-2) | | 139 (3.36) | 224 (4.33) | 279 | 317 (4.39) | 330 | 330 (4.40) | 314 (4.43) |
| 122 | Polyethylene glycol fatty acid ester type/Polyoxyethylene monooleate (MYO-2) | | 106 (3.65) | 201 (4.36) | 237 | 253 (4.41) | 270 | 271 (4.40) | 270 (4.42) |
| 123 | Polyoxyethylene hardened castor oil type/ Polyoxyethylene hardened castor oil (HCO-5) | | 90 (3.49) | 200 (4.37) | 239 | 250 (4.40) | 290 | 285 (4.43) | 275 (4.43) |

Numeral parenthesized: Thermal conductivity W/m · K

As can be seen from the results shown in Table 8, the addition effect can be obtained when the blending amount of the nonionic surfactant is not less than 0.2% by weight. Whereas, when not more than 0.1% by weight, the liquation consistency is less than 200, which means a poor addition effect to cause a problem about its dispense property.

Examples 124 to 140

Using the materials mentioned below, respective thermal conductive grease were obtained to study the effect of combination of the inorganic powder. The measurement results are as shown in Table 9.

(1) Nonionic surfactant: decaglyceryl pentaoleate, 1% by weight based on the weight of the inorganic powder.

(2) Base oil: poly-α-olefin, viscosity at 40° C.: 47 $mm^2/s$, 20% by volume.

(3) Inorganic powder: combination and blending proportion as shown in Table 9.

TABLE 9

| Example No. | Combination of powders and blending proportion thereof (%) Zinc oxide (0.65 μm) | Zinc oxide (12.6 μm) | Aluminum nitride (0.65 μm) | Aluminum nitride (13.3 μm) | Magnesium oxide (0.65 μm) | Magnesium oxide (13.5 μm) | Aluminum oxide (1.0 μm) | Titanium oxide (0.45 μm) | Boron nitride (6.97 μm) | Filler content of mixed powder (vol. %) | Liquation consistency (at 25° C.) | Thermal conductivity (W/m · K) |
|---|---|---|---|---|---|---|---|---|---|---|---|---|
| 124 | | | 40 | 60 | | | | | | 80 | 330 | 3.85 |
| 125 | | | | | 40 | 60 | | | | | 315 | 3.50 |
| 126 | | 60 | 40 | | | | | | | | 310 | 4.15 |
| 127 | | 60 | | | 40 | | | | | | 300 | 4.20 |
| 128 | | 60 | | | | | | 40 | | | 295 | 4.35 |
| 129 | 40 | | | 60 | | | | | | | 328 | 3.86 |
| 130 | | | | 60 | 40 | | | | | | 330 | 3.75 |
| 131 | | | | 60 | | | | 40 | | | 320 | 3.88 |
| 132 | 40 | | | | | 60 | | | | | 310 | 3.57 |
| 133 | | | 40 | | | 60 | | | | | 305 | 3.86 |
| 134 | | | | | | 60 | | 40 | | | 300 | 3.68 |
| 135 | | | | | | | | 40 | 60 | | 295 | 4.12 |
| 136 | | | 40 | | | | | | 60 | | 296 | 4.33 |
| 137 | | 40 | | | | | | | 60 | | 295 | 4.61 |
| 138 | | 60 | | | | | 40 | | | | 287 | 4.11 |
| 139 | | | | 60 | | | 40 | | | | 296 | 4.36 |
| 140 | | | | | | 60 | 40 | | | | 288 | 4.13 |

Numeral parenthesized: Average particle size
Base oil: Poly-α-olefin (viscosity at 40° C.: 47 $mm^2/s$)
Surfactant: Decaglyceryl pentaoleate (1% by weight based on filling weight)

There were obtained highly thermal conductive grease having a thermal conductivity as high as 3.68 to 4.35 W/m·K, and a liquation consistency of 300 to 330 to exhibit a satisfactory dispense property. Considering such liquation consistency, it is possible to attain a higher filler content of the mixed powder, thereby further improving thermal conductivity.

Examples 141 to 143

Figure 5:
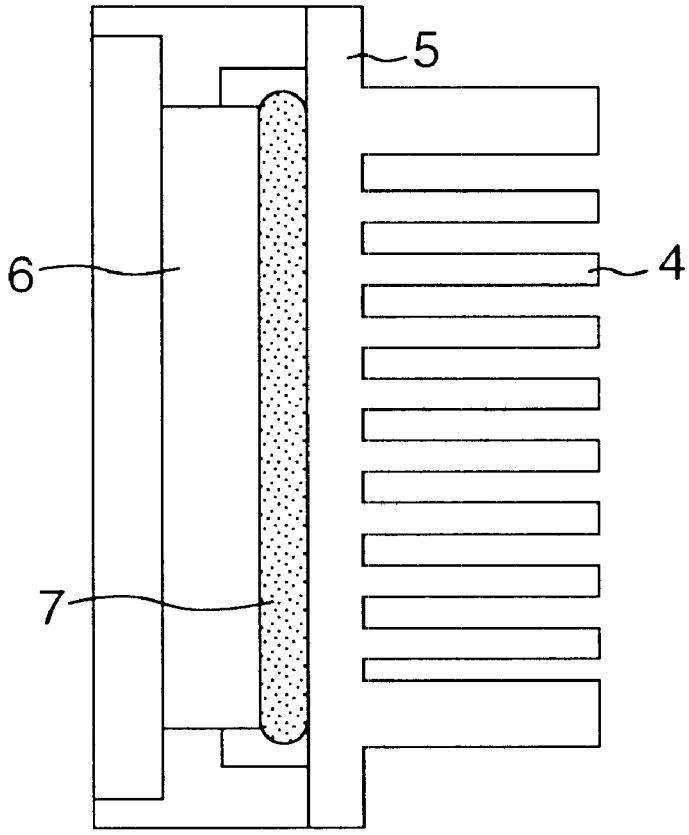
FIG. 5 is a vertically sectional view of a cooling device applicable to electric and electronic apparatus.

A cooling device shown in FIG. 5 was used. Each thermal conductive grease 7 obtained in Examples 41, 45 and 137 was filled between a radiating plate 5 of an aluminum-made radiator equipped with a fin 4 (6 cm×6 cm) and a 80W exothermic body 6 (5×5 cm), whose surface had been processed to have a surface coarse (Ra) of 0.1 μm.

A grease thickness was adjusted to 0.23 mm. A temperature difference between a neighboring temperature (1 mm depth from the grease-adhering surface) of a grease contact surface in the exothermic body 6 and that (1 mm depth from the grease-adhering surface) of a grease contact surface in the radiating body 5 was measured to measure a thermal resistance (° C./W) of the grease layer. Further, the cooling device was allowed to stand in a thermostat of 100° C. for 50 hours to study the isolation state of the base oil and flow state (retention property) of the grease. The results are as shown in Table 10.

The cooling device applied with any of the grease obtained in Examples 141 to 143 was found to have a thermal resistance of from 0.096 to 0.103° C./W, namely found to exhibit a satisfactory cooling performance. There was observed no oil diffusion due to oil isolation. In addition, there was observed little flow of the grease and therefore the grease exhibited a satisfactory retention property. In conclusion, significance of the grease was confirmed.

Comparative Example 26

Using the materials mentioned below without adding any surfactant, thermal conductive grease was obtained, and applied to the cooling device shown in FIG. 5 in a manner similar to that of Example 141. The measurement results are as shown in Table 10.

TABLE 10

| Item | Example 141 | Example 142 | Example 143 | Comparative Example 26 | Comparative Example 27 |
|---|---|---|---|---|---|
| Liquation consistency | 252 | 320 | 295 | 310 | 275 |
| Thermal resistance (° C./W) | 0.096 | 0.103 | 0.098 | 0.125 | 0.121 |
| Bleeding degree (mm) | 1.0 | 1.3 | 1.2 | 3.3 | 4.3 |
| Flow of grease (mm) | None | None | None | 2.0 | 3.2 |

(1) Base oil: poly-α-olefin oil (SHC 230, manufactured by Mobil Petroleum Ltd.), viscosity at 40° C.: 209 $mm^2/s$, 10% by weight.

(2) Inorganic powder: mixed powder of 81% by weight of synthetic diamond particles having an average particle size of 2.5 μm and 9% by weight of zinc oxide particles having an average particle size of 0.2 μm, blending proportion of the zinc oxide=10% by volume based on the volume of the whole inorganic powder.

Comparative Example 27

Using the materials mentioned below without adding any surfactant, thermal conductive grease was obtained, and applied to the cooling device shown in FIG. 5 in a manner similar to that of Example 141. The measurement results are as shown in Table 10.

(1) Base oil: fluoro-oil (Demnum S-200, manufactured by Daikin Industries Ltd.), viscosity at 40° C.: 210 $mm^2/s$, 10% by weight.

(2) Inorganic powder: mixed powder of 72% by weight of synthetic diamond particles having an average particle size of 2.0 μm and 18% by weight of boron nitride particles having an average particle size of 0.3 μm.

The grease obtained in Comparative Examples 26 and 27 are found to have a liquation consistency similar to that of those obtained in Examples 141 to 143, the thermal conductivity thereof is found to be larger as compared thereto, and the bleeding width is found to be remarkably larger. In addition, flow of the grease can be observed, and therefore it can be said that the both grease are inferior to those of Examples 141 to 143 in performance as the thermal conductive grease to be applied to a cooling device.

Advantageous Effect of the Invention

The thermal conductive grease composition in accordance with the present invention can attain a thermal conductivity of from 3.0 to 5.5 W/m·K and a liquation consistency of from 200 to 400 at the same time, namely both a high thermal conductivity and a satisfactory dispense property. Further, by using the thermal conductive grease composition in accordance with the present invention, heat generated in electric and electronic components can be effectively removed, and therefore it is possible to increase reliability of components for electric and electronic apparatus, and make a cooling device compact.

What is claimed is:

1. A highly thermal conductive grease composition which comprises an inorganic powder and a base oil containing a mineral oil or a synthetic oil, wherein the inorganic powder is a mixture of at least two kinds of inorganic powders different from each other in each average particle size, the base oil further contains a surfactant in an amount of from 0.2 to 2.0% by weight based on the weight of the inorganic powder, and a content of the base oil is from 10 to 30% by volume, and a content of the inorganic powder is from 70 to 90% by volume.

2. The highly thermal conductive grease composition according to claim 1, wherein the content of the inorganic powder $\phi$ (% by volume) and a viscosity $\eta$ ($mm^2/s$) at 40° C. of the base oil are expressed by the following expression (1).

$$\text{Log } \phi \leqq -1\times10^{-18}\times(\eta-250)^5+1.9345 \quad (1)$$

3. The highly thermal conductive grease composition according to claim 1, wherein the viscosity at 40° C. of the base oil is from 15 to 450 $mm^2/s$, and the base oil comprises at least one member selected from the group consisting of α-olefin oligomers, diesters, polyol esters, trimellitic acid esters, polyphenyl ethers and alkyl phenyl ethers.

4. The highly thermal conductive grease composition according to claim 1, wherein the inorganic powder is a combination of from 40 to 90% by volume of coarse particles having an average particle size of from 5 to 17 $\mu$m and 10 to 60% by volume of fine particles having an average particle size of from one third to one fortieth of that of the coarse particle size, and the inorganic powder comprises at least one member selected from the group consisting of zinc oxide, magnesium oxide, titanium oxide, aluminum nitride, aluminum oxide and boron nitride.

5. The highly thermal conductive grease composition according to claim 1, wherein a liquation consistency is from 200 to 400.

6. The highly thermal conductive grease composition according to claim 1, wherein the surfactant is a nonionic surfactant having an HLB value of not more than 9.

7. A cooling device provided with an electric or electronic component assembled into an apparatus and a cooling body put on a surface of said component, in which the highly thermal conductive grease composition according to any of claims 1 to 6 intervenes between said cooling body and a surface of an exothermic body in said component.

* * * * *

UNITED STATES PATENT AND TRADEMARK OFFICE

CERTIFICATE OF CORRECTION

PATENT NO. : 6,632,780 B2
DATED : October 14, 2003
INVENTOR(S) : Uematsu et al.

It is certified that error appears in the above-identified patent and that said Letters Patent is hereby corrected as shown below:

Title page,
Insert item:
-- [30] Foreign Application Priority Data
Jan. 4, 2001 (JP).....2001-000053 --

Signed and Sealed this

Twenty-seventh Day of April, 2004

JON W. DUDAS
*Acting Director of the United States Patent and Trademark Office*